United States Patent [19]

Mette

[11] 4,307,762

[45] Dec. 29, 1981

[54] ARRANGEMENT FOR FILLING BEVERAGES INTO CONTAINERS

[75] Inventor: Manfred Mette, Hamburg, Fed. Rep. of Germany

[73] Assignee: Ortmann & Herbst GmbH, Hamburg, Fed. Rep. of Germany

[21] Appl. No.: 90,444

[22] Filed: Nov. 1, 1979

[30] Foreign Application Priority Data

Nov. 9, 1978 [DE] Fed. Rep. of Germany ..... 2848604

[51] Int. Cl.[3] ..... B65B 31/00

[52] U.S. Cl. ..... 141/284; 41/302; 41/392

[58] Field of Search ..... 141/4, 5, 6, 37, 39, 141/40, 46, 198, 284, 301, 302, 263, 270, 392; 222/522, 525

[56] References Cited

U.S. PATENT DOCUMENTS 1,915,066 6/1933 Meyer ..... 141/39

2,208,028 7/1940 Harrington ..... 141/263

3,595,281 7/1971 Laub ..... 141/198 X

*Primary Examiner*—Frederick R. Schmidt

*Attorney, Agent, or Firm*—Michael J. Striker

[57] ABSTRACT

An arrangement for filling containers with beverages has a housing with a wall bounding a closed air chamber, a filling pipe vertically displaceable in the housing so that the filling pipe can be lifted to thereby allow the exchange of containers, and a drive for vertically displacing the filling pipe and including a shaft which cooperates with an upper end portion of the filling pipe so as to vertically displace the latter, which drive is accommodated in the closed air chamber and its shaft extends through the wall of the air chamber. The filling pipe may be provided with inlet openings arranged below the air chamber in the region of a liquid inlet in the housing. A liquid valve may control the liquid inlet and be provided with a further drive operating independently of the drive of the filling pipe.

9 Claims, 1 Drawing Figure

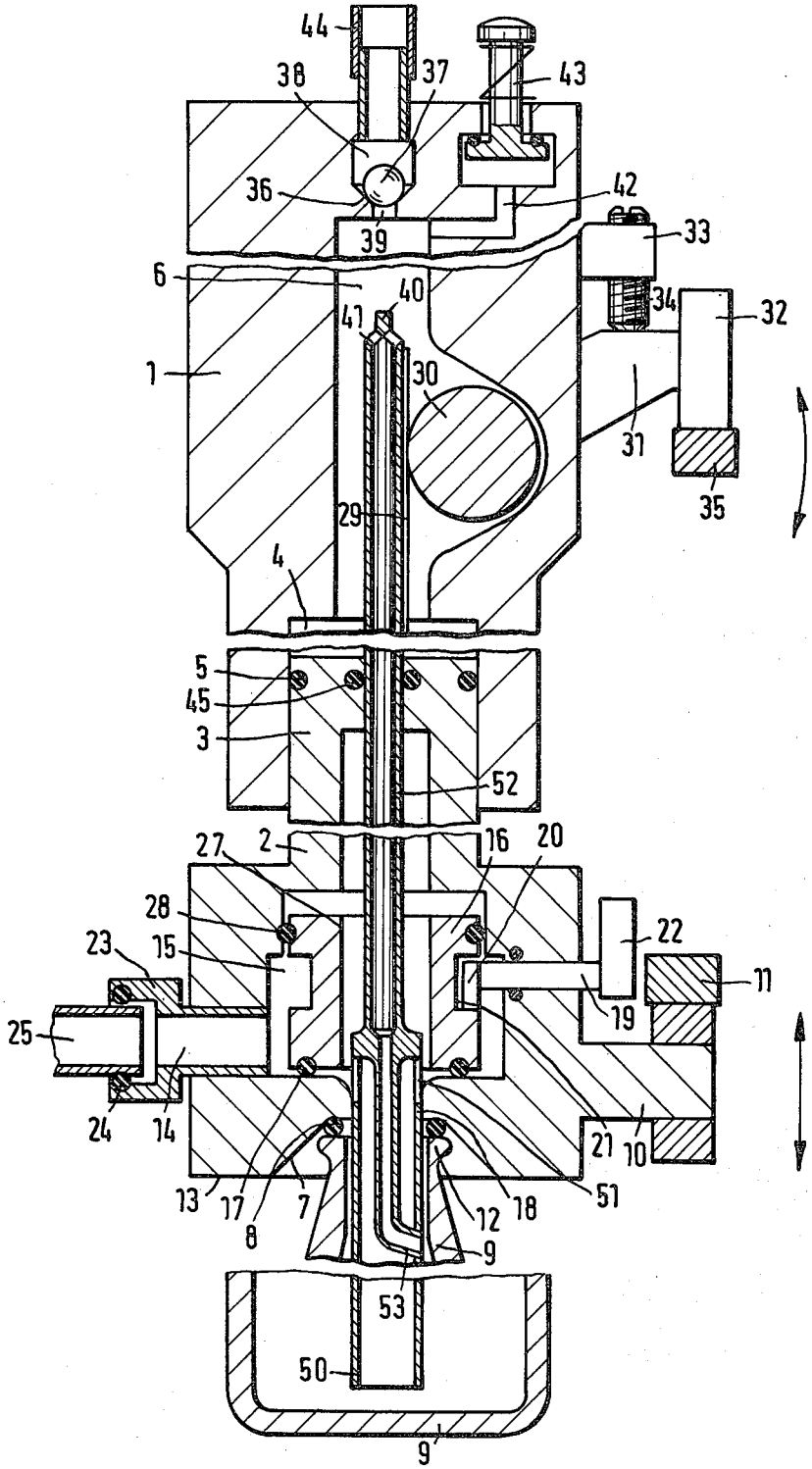
44
38
37
43
36
42
39
33
6
40
34
32
41
1
30
31
35
29
4
5
45
3
52
27
2
16
20
28
22
23
15
11
19
25
24
14
21
10
13
17
7
18
51
8
12
9
53
50
9'

ARRANGEMENT FOR FILLING BEVERAGES INTO CONTAINERS

BACKGROUND OF THE INVENTION

The present invention relates to an arrangement for filling beverages into containers.

Filling arrangements are known in the art. One of such arrangements is disclosed in the U.S. Pat. No. 2,138,355. The arrangement is provided with a vertically movable filling pipe which has the advantage in that the exchange of containers can be performed in a position in which the filling pipe is withdrawn upwardly so that the container is fully released. At the same time, the container can be moved only in one plane without lifting thereof. The known construction is provided for still beverages which can be filled without pressure. The means for lifting the filler pipe may be arranged without difficulty, since they project outside the filling device and are there connected by gears to a drive shaft in the atmosphere. However, this construction is not suitable for use as a counter-pressure filler apparatus in whch the interior of the filling device is under considerable pressure, e.g. 6 bars. The sliding seal on the filler pipe would present considerable problems.

SUMMARY OF THE INVENTION

Accordingly, it is an object of the present invention to provide a filling arrangement which avoids the disadvantages of the prior art.

More particularly, it is an object of the present invention to provide a filling arrangement which is better suitable for the counterpressure filling process.

In keeping with these objects and with others which will become apparent hereinafter, one feature of the present invention resides, briefly stated, in an arrangement for filling containers with beverages, which has a housing, a filling pipe vertically displaceable in the housing so that it can be lifted to thereby allow the exchange of containers, and drive means for vertically displacing the filling pipe which drive means includes a shaft cooperating with an upper end portion of the filling pipe so as to vertically displace the latter, whereby the drive means is accommodated in the closed air chamber of the housing and the shaft of the drive means extends through a wall bounding the air chamber. In such a construction, the filling pipe in the filling position of the filling apparatus extends completely in the interior of the pressure region, so that no pressure seals for its movement is needed. The drive shaft, however, extends through the housing of the filling apparatus. As for the sealing problem, a sealing of a rotational part is simpler than a filling of the translatorily displaceable part.

From the German Pat. No. 1,944,595 a counterpressure filling arrangement with filling pipe is known in which the filling pipe is also vertically movable. In this construction, however, no self-contained lifting drive for the filling pipe is provided. Drive means is mounted on a liquid valve operative for small opening stroke, and is operative for common movement. However, here a structural simplification and not a vertical movement of the filling pipe is desired. In this known construction the filling pipe in the region of the liquid inlet is provided with inlet openings and has integral downwardly extending return air extension and an upwardly extending pipe formed as a return air pipe.

In accordance with another advantageous feature of the present invention, the filling pipe below the air chamber is provided in the region of a liquid inlet which is controlled by a valve, with inlet openings. The filling pipe above the inlet openings is formed as a return air pipe, and the latter has an integral return air extension which extends through the interior of the lower portion of the filling pipe, whereby the upper end of the return air pipe is open to the air chamber connected with a return air conduit. These features in connection with one another provide for advantageous separation of the liquid flow from air space in that the lifting drive is performed free from contact with liquid. This results in the advantage in that the contamination of the drive is prevented and the service life of the latter is increased. This also makes possible significant return air flow, in which case the air space for dry accommodation of the drive means is utilized as a return air space.

Finally, in accordance with the present invention, it is advantageous when the liquid valve is formed by an annular member which surrounds the filling pipe and is provided with drive means which is independent from the drive means of the filling pipe. In such a construction, the arrangement of the liquid valve is space-economical, and the liquid flows along a short path directly into the inlet openings of the filling pipe. The mechanical coupling of the filling pipe on the liquid valve is eliminated by separate construction of these both parts. The liquid valve in such a construction is independently controlled from a separate drive.

The inventive construction is especially advantageous when the filling apparatus has a vertically movable lower part for attaining the sealing stroke in order to seal the container to the container seal of the housing. Since the filling pipe has its own lifting drive which is independent of the movement of the lower part, it can move fast over considerable depth due to its small mass. The mechanically fully independently movable lower part must perform in this construction only the small sealing stroke. In such a construction it is possible even in the condition of very high operational speed to omit a separate lifting drive for the container.

The inventive filling arrangement is utilized in operation on a rotary charger or filling apparatus with $CO_2$-containing beverages such as beer, lemonade or the like for filling the same into bottles. Several filling arrangements are mounted on one charger in order to increase the output.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawing is a view which schematically shows a filling arrangement in accordance with the present invention.

DESCRIPTION OF THE PREFERRED EMBODIMENT

A filling arrangement is composed of two housing parts. The upper housing part in the drawing is formed as a fixed head part 1 which is mounted on a filling apparatus in a not shown manner. The lower part 2 is formed at its upper end as a piston 3. The latter slidingly extends in a cylindrical receiving hole 4 of the head part 1 and sealed by a piston seal 5. The cylindrical hole 4 communicates with a return air space 6 in the head part 1.

A container seal 8 is located in a conical central recess 7 provided at the lower side of the lower part 2. The container seal 8 seals downwardly open liquid outlet of the filling arrangement against an edge 12 of a bottle 9 located below the filling arrangement.

A carrier member 10 is mounted laterally on the lower part 2, outwardly of the axis of rotation of the filling apparatus, which axis is located at the left side. The carrier member 10 during the rotation of the filling apparatus engages with a not-shown lifting cam which acts from below, or with a lowering cam 11. Thereby, the lower part 2 moves relative to the fixed head part in a lifting stroke which somewhat exceeds the dipping depth of the bottle 9 into the central recess 7 of the lower part 2. When subsequently the exchange of the containers takes place, a filling pipe 50 of the lifting system can be lifted to such extent that it does not hinder the containers exchange.

The exchange of the container is performed in the following manner: The filling pipe 50 is lifted from its shown filling position, and then the lower part 2 is lifted by the lifting cam on the carrier member 10 to such extent that the edge 12 of the bottle is located below a lower edge 13 of the filling arrangement. Then, the bottle is laterally removed without vertical movement and is replaced by an empty bottle. The new bottle is centered under the filling arrangement coarsely. Then the lower part 2 of the filling arrangement is lowered onto the bottle with the aid of the lowering cam 11 or, in some cases, without such cam under the action of its own weight. Engagement of the edge 12 of the bottle with the conical central recess 7 results in fine adjustment, until the container seal 8 is brought into sealing abutment against the bottle edge 12.

Now the process of filling may begin. In order to begin this process, the return gas space 6 and therewith the cylindrical space 4 of the head part 1 is set under pressure by pressurized gas, so that the lower part 2 is pressed with sealing force against the bottle, which advantageously depends on the sealing pressure. The pressing force resulting from the gas pressure multiplied by the difference between the face area of the piston 3 and the cross-section of the bottle edge 12.

The supply of the liquid to the bottle 9 is performed through a lateral liquid inlet 14 which is open into a valve chamber 15 of the lower part 2. A valve body 16 surrounds the filling pipe 50 at a distance therefrom and is located in the valve chamber 15. The valve body 16 is vertically liftable and lowerable, and abuts in its lower position with an annular seal 17 the bottom of the chamber. Thereby the liquid inlet 14 is sealed against the filling pipe 50.

A shaft 19 is supported in the lower part 2. The inner end portion of the shaft 19 extends into the valve chamber 15 and carries there a dog 20 which engages in an annular groove 21 of the valve body 16. The outer end portion of the shaft 19 carries an outer dog 22. The latter is controlled by not shown lifting and lowering cams during the filling process so that the valve body 16 is lifted for passing of the liquid or lowered for blocking the same.

The liquid inlet 14 is located at the side of the filling arrangement which is adjacent to the axis of rotation of the filling apparatus. A pipe 23 of a greater diameter is mounted on the liquid inlet 14. An elastic annular seal 24 is seated in the inner wall of the pipe 23. A long and rigid pipe 25 is sealingly clamped in the annular seal 24 without contact with the pipe 23 mounted on the lower part 2 of the filling arrangement. The pipe 25 extends over a long distance, for example more than one meter, to a liquid connection, for example a central tank arranged in the axis of rotation of the filling apparatus. The inner connection of the pipe 25 is formed in accordance with the parts 23, 24, 25 shown in the drawing. The pipe 25 is supported at its both ends by an elastic sealing ring. Small inclination of the long pipe 25 resulting from relative small lifting of the lower part 2 is absorbed in the seal rings of the pipe ends.

The filling pipe 50 is shown in the drawing in its lower position in which it extends to the bottom of the bottle 9. The filling pipe 50 is formed as a filling pipe only in its lower region and is located in the position shown in the drawing so that the upper end of its lower part is situated at the height corresponding to the liquid valve seat 17. As can be seen in the drawing, the filling pipe in this region is provided with inlet openings 51. Above the inlet openings, the filling pipe is closed and has a return air pipe 52 which extends upwardly to the return air space 6. The return air pipe 52 in the region within the filling pipe 50 is connected with return air pipe portion 53 which extends inside the filling pipe 50 until it is open into its outer wall at the height corresponding to the maximum level of filling of the bottle 9. The filling pipe together with its return air pipe part 52 is movably guided in the piston portion 3 of the lower part 2 and sealed during this movement by an annular seal 45. The return air pipe extends through the valve body 16 of the liquid valve within a throughgoing opening 27 having a greater diameter. Since the part of the valve chamber 15 above the valve body 16 communicates with the interior of the bottle 9 through the opening 27, an annular seal 28 is arranged adjacent to the upper edge of the valve body so as to seal the valve body against the valve chamber wall. In this case, in the sealing point of the valve body overrunning of the liquid through the opening 27 is prevented. Filling of the filling pipe 50 in the valve body 16 can thereby be omitted.

The return air pipe part 52 of the filling pipe 50 extends into the return air space 6 of the head part 1 and is provided at its outer side in this region with rack teeth 29 which engage with a pinion 30 located in the head part 1. The pinion 30 has a shaft extending outwardly beyond the head part and mounting a lever 31 whose outer end portion is provided with a cam follower 32. The lifting drive can also be formed in another manner, for example as a looped rope drive. In such a construction, a rope (corresponding to the position 29) connected with both ends above and below the return air pipe 52 extends around the shaft (corresponding to the position 30) and cooperates with the same by friction whereby by rotation of the shaft the return air pipe 52 and thereby the filling pipe 50 is raised in desired manner.

As can be seen from the drawing, the filling pipe 50 is guided downwardly by a sleeve-like opening 18 in the lower part 2 of the filling arrangement. At this point no particular guidance or sealing is required inasmuch as the filling pipe fills this socket with relatively small play so that an uncontrolled flow of the liquid outwardly of the filling pipe under the direction of small pressure generated during filling in the bottle will be avoided.

The head part 1 has a projection 33 in which an adjusting screw 34 is provided. The lower end of the adjusting screw 34 forms an adjustable abutment for the lever 31. The cam follower 32 extends during the filling process in engagement with a not shown lowering cam and with a lifting cam 35 which is shown in the drawing, whereby the filling pipe can be lowered or lifted. In the filling position of the filling arrangement shown in the drawing, the filling pipe 50 is situated in its lowest position in which its lower end extends to the bottom of the bottle 9. For this purpose, the lever 31 actuating the lifting movement of the filling pipe is lifted with the aid of the lifting cam 35. In order to exchange the container after the filling process, the lever 31 is so lowered that the lifted filling pipe with its lower edge is located above the edge 13 of the filling arrangement. As mentioned above, it suffices for the container exchange to perform only a small relative lift of the lower part 2 in order to release the bottle 9 from the filling arrangement.

In the shown filling position, the filling pipe 50 must be adjusted in its lifted location extremely accurately in order to insure that the opening of the return air pipe portion 53 which determines the filling level of the bottle 9 is situated in the desired vertical position in the bottle. In the shown example, this filling position is accurately guaranteed by the abutment of the lever 31 against the adjusting screw 34. By means of the adjusting screw, the inaccuracy of the filling apparatus or deviations of the filling arrangement can be compensated. In this embodiment, the lifting cam 35 is advantageously spring-biased in order to eliminate destruction. Respective spring-biasing can also be provided between the lever 31 and the cam follower 32. In accordance with another embodiment of the invention which is not shown in the drawing, the lifting cam 35 is adjustable in the vertical direction with omission of the adjusting screw 34. The exact filling position of the filling pipe 50 is performed by the adjustment of the lifting cam. It is advantageous when the filling position of the filling pipes is adjusted for all filling arrangements of the apparatus on the lifting cam. This embodiment is recommended when different bottles having different filling heights must be filled in the same filling apparatus to their different filling levels with fast adjustment of the filling apparatus to the next type of bottles.

A pressurized gas conduit 44 opens concentrically above the return air pipe 52 through a pre-air valve in the return air space 6 of the head part 1. The pre-air valve is composed of a valve chamber 38 with a synthetic plastic ball 37 abutting against a lower conical seat face 36. The ball is freely movable in the valve chamber 38 and lies in force-free condition under the action of its own weight sealingly against the seat face 36 so as to close an opening 39 which leads downwardly into the return air space 6. At the upper end of the return air pipe 52, the latter narrows to a central portion 40 and is provided with openings 41. The portion 40 has a diameter which is smaller than that of the opening 39. It has such a length that in the lifted position of the return air pipe during the container exchange it is located just below the ball 37 of the ball valve.

The gas conduit 44 is always under pressure. In the container exchange position in which the return air space 6 communicates with the surroundings through the return air pipes 52 and 53, the ball 37 is sealingly pressed against the seat 36. In order to start the filling process, the pre-air valve must be opened for a short time in order to pressurize the return air space 6 and the inner space of the bottle 9 connected therewith. For this purpose, the lever 31 wich controls the return air pipe 52 is so actuated by a not shown additional lowering cam in additional lift that the return air pipe with its upper portion 40 lifts the ball 37 of the pre-air valve. After a short opening of the pre-air valve, the return air pipe can again be lowered since now the bottle 9 is pressurized. During the subsequent filling process the liquid level in the bottle raises and expells air through the return air pipes 52 and 53 into the return air space 6. The gas flowing backwardly lifts the ball 37 which for this purpose has a small specific weight, and flows back in known manner into the gas conduit 44. When the bottle 9 during the filling process breaks, the ball valve 37 closes automatically.

An relief conduit 42 is connected with the return air space 6 at its upper region. This conduit leads to an relief valve 43. The latter is closed under the action of spring pressure and also under the action of the pressure of locking gas. The relief valve 43 for depressurization is actuated by means of a not shown further control cam. The depressurizing process takes place in known manner at the end of the filling process in order to relieve the residual gas space in the bottle and the gas space in the filling arrangement communicating therewith, to atmospheric pressure. Thereby, the liquid in the bottle 9 during lifting of the filling arrangement does not generate foam. The relief is performed gradually, wherefore the relief conduit 42 and/or the relief valve 43 is formed flow reducing. Since this means is provided high above in the sealing arrangement, it is guaranteed that during relieving no liquid from liquid moisturized walls will be entrained.

In the above-disclosed embodiment of the filling arrangement it must be however guaranteed that during the relief process the return air pipe is empty. When the return pipe is provided at its lower end with a valve, this is performed automatically. In the downwardly open return air pipe 52 and 53, it must be provided that after the termination of the filling process the liquid column in the return air pipe is drained before the relief process. This is attained by lifting of the return air pipe before the loading process. Since the spaces at both ends of the return air pipe are locked from one another after the termination of the filling process, during the lifting of the return air pipe gas from the return air space 6 travels through the return air pipe downwardly and expells the liquid column.

In deviation from the above-described embodiment, the piston/cylinder connection of the lower part 2 with the head part 1 may be so formed that the cylinder is provided on the lower part 2 and the piston is provided on the head part 1. However, it is important to arrange this piston/cylinder construction above the liquid valve chamber 15. As can be seen from the drawing, the total guidance of liquid in the lower part 2 in such a construction can be provided in optimum manner in the sense of flow technique. Thus it is possible, for example, to form a part of the valve chamber located below the seal 28 of the valve body 16, of a proper width as a twist generating spiral inlet chamber.

The lifting drive of the filling pipe may also be formed in another manner. For example, the filling pipe may be lifted by a fork or the like. The lifting drive may also be provided in the lower part 2 of the filling apparatus. However, it is advantageous when in this case it is arranged above the valve chamber in order not to interfere with its construction.

It will be understood that each of the elements described above, or two or more together, may also find a useful application in other types of constructions differing from the types described above.

While the invention has been illustrated and described as embodied in an arrangement for filling beverages, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for filling containers with beverages, comprising a housing including a closed air chamber; a filling pipe being vertically displaceable in said housing and including an upper end portion with an upper end and forming a return air pipe and a lower pipe portion having inlet openings located below said air chamber; drive means for vertically displacing said filling pipe so that said filling pipe can be lifted to thus allow the exchange of the containers; said air return pipe having an extension extending into the interior of said lower portion; liquid inlet means in said housing in the vicinity of said inlet openings; a valve for controlling said liquid inlet means located in said housing in the region of said liquid inlet means; first sealing means on said valve adapted to seal said inlet means from said inlet openings; a pressurized gas conduit above said air chamber and adapted to communicate therewith; and second sealing means between said air chamber and said conduit.

2. The arrangement as defined in claim 1, wherein said second sealing means include a seat formed in said housing and a ball situated in said seat and displaceable relative thereto.

3. The arrangement as defined in claim 2, wherein said valve is displaceable relative to said liquid inlet means.

4. An arrangement as defined in claim 3, wherein said valve is formed by an annular member surrounding said filling pipe.

5. An arrangement as defined in claim 4; and further comprising further drive means arranged to drive said valve and operating independently of said first-mentioned drive means of said filling pipe.

6. The arrangement as defined in claim 1, wherein said drive means include a shaft which cooperates with said upper end portion of said filling pipe and are accommodated in said closed air chamber.

7. An arrangement as defined in claim 1, wherein said return air pipe and said extension are of one piece with one another.

8. An arrangement as defined in claim 1, wherein said return air pipe has an upper end which is open toward said air chamber.

9. An arrangement as defined in claim 8; and further comprising a return air conduit with which said air chamber is connected.

* * * * *